US011219996B1

(12) United States Patent
Bryant

(10) Patent No.: US 11,219,996 B1
(45) Date of Patent: Jan. 11, 2022

(54) MOTORCYCLE LIFT ATTACHMENT

(71) Applicant: William Bryant, New York, NY (US)

(72) Inventor: William Bryant, New York, NY (US)

( * ) Notice: Subject to any disclaimer, the term of this patent is extended or adjusted under 35 U.S.C. 154(b) by 144 days.

(21) Appl. No.: 16/669,815

(22) Filed: Oct. 31, 2019

(51) Int. Cl.
*B25H 1/00* (2006.01)
*B66F 3/36* (2006.01)

(52) U.S. Cl.
CPC ..... *B25H 1/0014* (2013.01); *B66F 3/36* (2013.01)

(58) Field of Classification Search
CPC ..... B66F 13/00; B66F 19/00; B66F 2700/12; B66F 2700/123; B66F 2700/126; B66F 7/26; Y10S 254/04; Y10S 254/16
See application file for complete search history.

(56) References Cited

U.S. PATENT DOCUMENTS

| | | | | |
|---|---|---|---|---|
| 5,769,397 | A | 6/1998 | Dhein | |
| 6,286,814 | B1 | 9/2001 | Heyne | |
| 2005/0253122 | A1* | 11/2005 | Jones | B66F 7/243 254/88 |
| 2017/0183207 | A1* | 6/2017 | Kochie | B66F 7/28 |

* cited by examiner

*Primary Examiner* — Tyrone V Hall, Jr.
(74) *Attorney, Agent, or Firm* — Sanchelima & Associates, P.A.; Christian Sanchelima; Jesus Sanchelima

(57) ABSTRACT

A lift attachment to be used on motorcycles is disclosed herein. The lift attachment includes floor jacks comprising a horizontal central cycle support section having a vertical member on each end which terminate in horizontal jack attachment members, where the device can be a single piece or composed of multiple pieces removably attached to one another. The lift attachment is then placed underneath a motorcycle. A jack lift is then mounted on the horizontal jack attachment members. The jack maybe a hydraulic jack or an automatic jack. A user may then actuate each of the jacks placed on the ends of the lift attachment. The lift attachment is then raised a predetermined height, thereby lifting the motorcycle a predetermined amount. The lift attachments raise a motorcycle the necessary height needed for working on a motorcycle.

8 Claims, 4 Drawing Sheets

MOTORCYCLE LIFT ATTACHMENT

BACKGROUND OF THE INVENTION

1. Field of the Invention

The present invention relates to a lift attachment and, more particularly, to a motorcycle lift attachment.

2. Description of the Related Art

Several designs for a motorcycle lift attachment have been designed in the past. None of them, however, include a motorcycle lift attachment for floor jacks comprising a horizontal central cycle support section having a vertical member on each end which terminate in horizontal jack attachment members, where the device can be a single piece or composed of multiple pieces removably attached to one another. It is known, that user's often working on motorcycles often have a need to lift their motorcycle on a jack in order to properly perform mechanical work. It is also known that a user may also need to properly lift the entire motorcycle. Therefore, there is a need for a motorcycle lift attachment that is configured to be used with a plurality of jacks in order to aid a user in lifting their motorcycle for mechanical maintenance. The attachment may additionally also be used in other additional settings. For example, it may be adapted for use as a storing aid to store a user's items.

Applicant believes that a related reference corresponds to U.S. Pat. No. 6,286,814 issued for a motorcycle support device for a floor jack. Applicant believes another reference relates to U.S. Pat. No. 5,769,397 issued for a vehicle lifter attachment However, these references differ from the present invention because they fail to disclose a motorcycle lift attachment for floor jacks comprising a horizontal central cycle support section having a vertical member on each end which terminate in horizontal jack attachment members, where the device can be a single piece or composed of multiple pieces removably attached to one another. The present invention addresses these issues by including a lift attachment that may be configured to be operated with a variety of jacks. Additionally, the present invention is easy to use and allows a user to properly access the necessary components needed for performing mechanical operations on the motorcycle.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a motorcycle lift attachment which fulfills the need for an improved vehicle jack lifting or cable hoisting accessory.

It is another object of this invention to provide a motorcycle lift attachment that eliminates the need for assistance from a second person in performing mechanical work on a motorcycle.

It is still another object of the present invention to provide a motorcycle lift attachment that is useful for all two and four wheeled vehicle owners, contractors, construction workers, and anyone who requires an object to be lifted.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
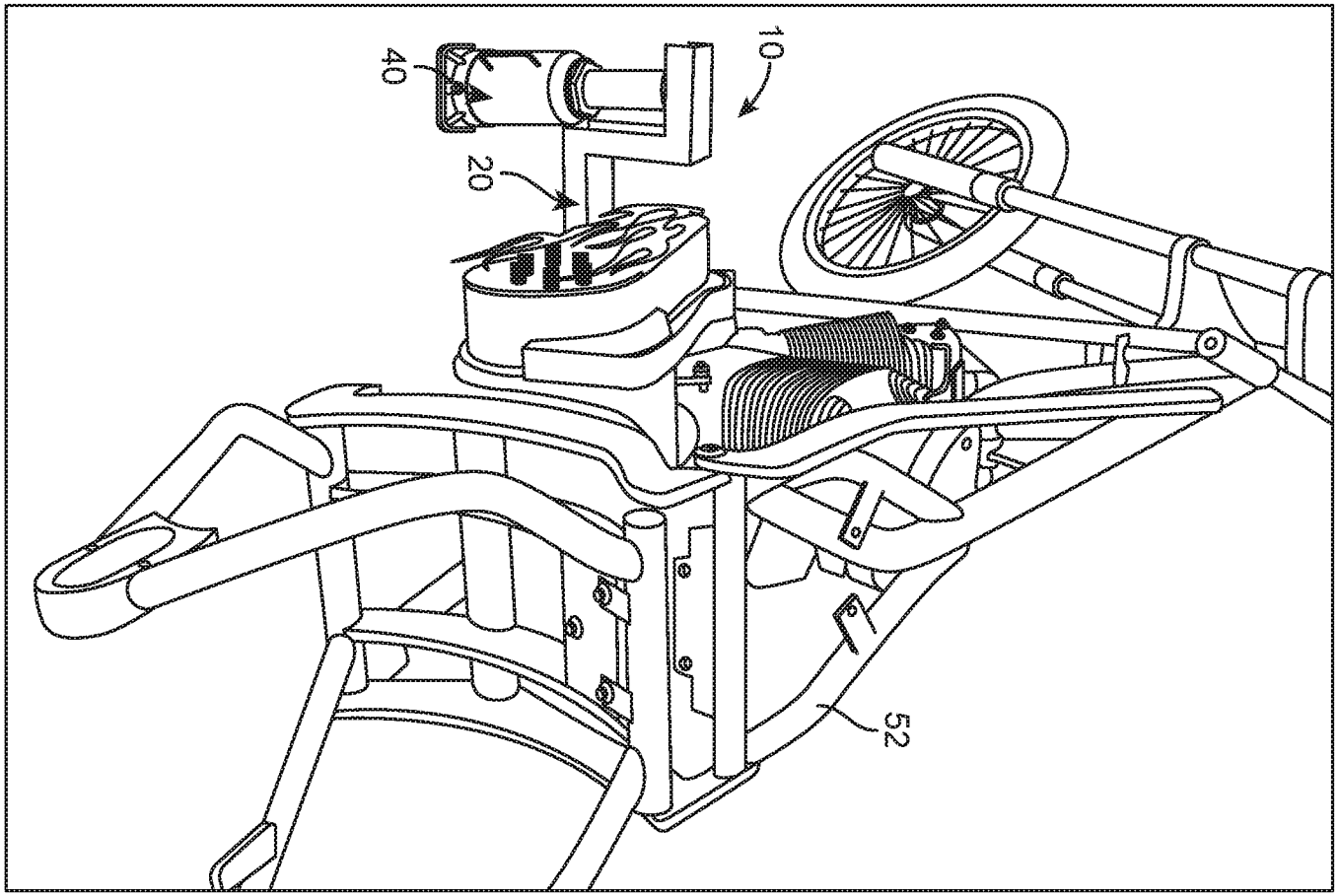
FIG. 1 represents a view of lift attachment 10 in an operational setting in use with a motorcycle 52 in accordance to an embodiment of the present invention.
Figure 2:
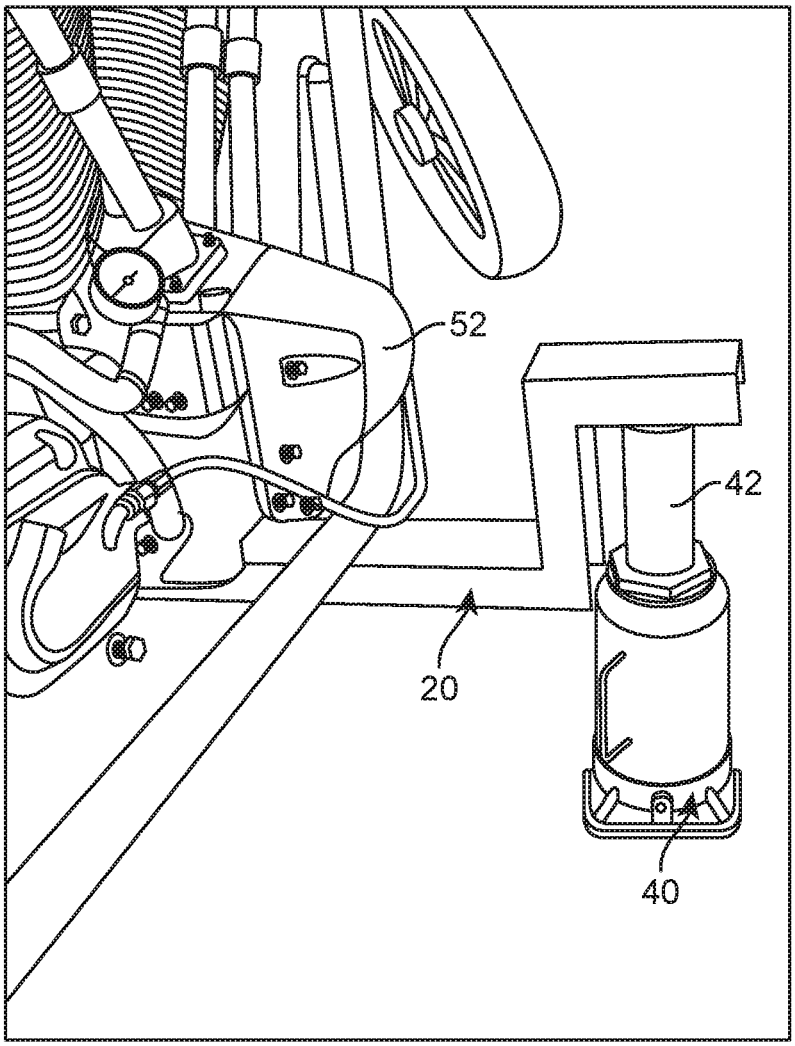
FIG. 2 shows an enlarged view of lift attachment 10 in its operational setting in accordance to an embodiment of the present invention.
Figure 3:
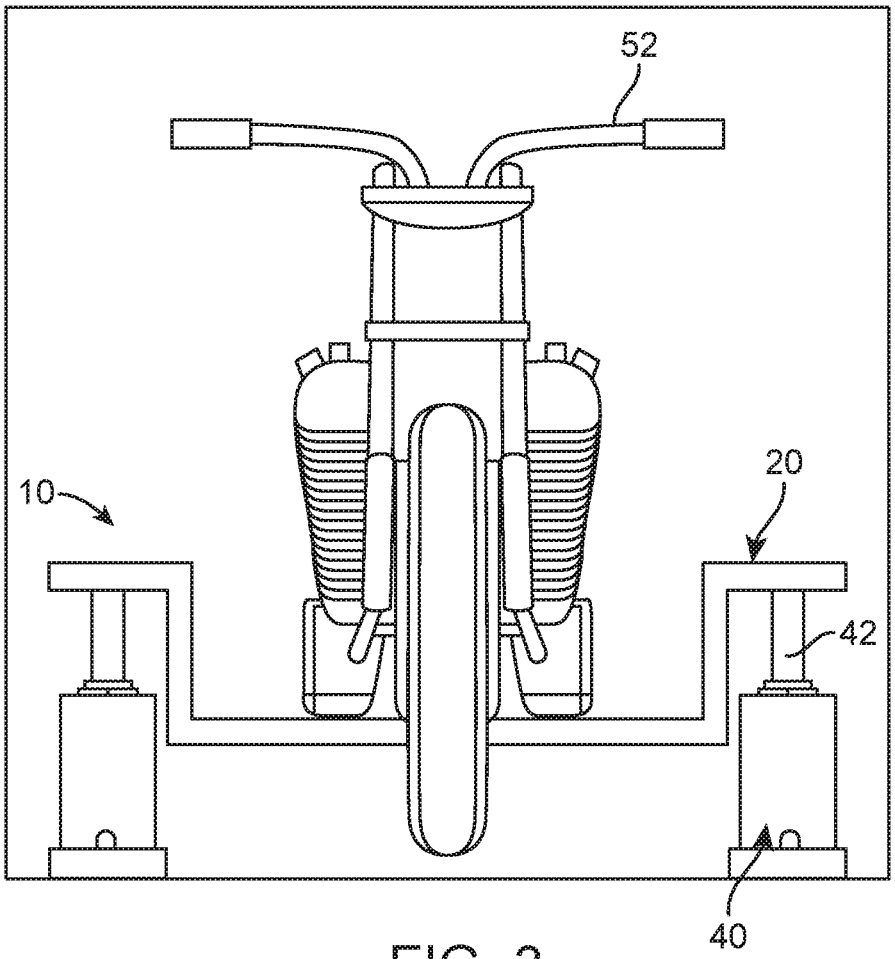
FIG. 3 illustrates a front view of lift attachment 10 in its operational setting in accordance to an embodiment of the present invention.
Figure 4:
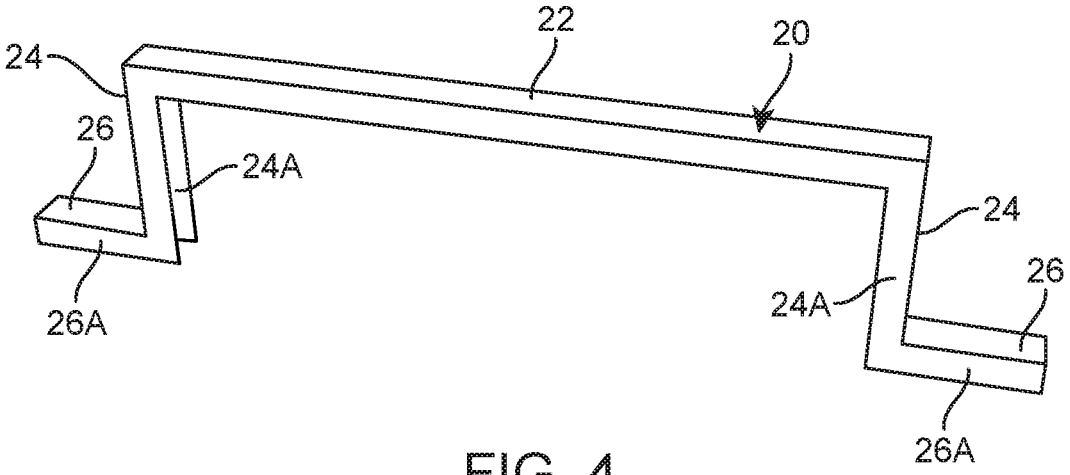
FIG. 4 is a representation of an isometric view of lift attachment 10 in accordance to an embodiment of the present invention.
Figure 5:
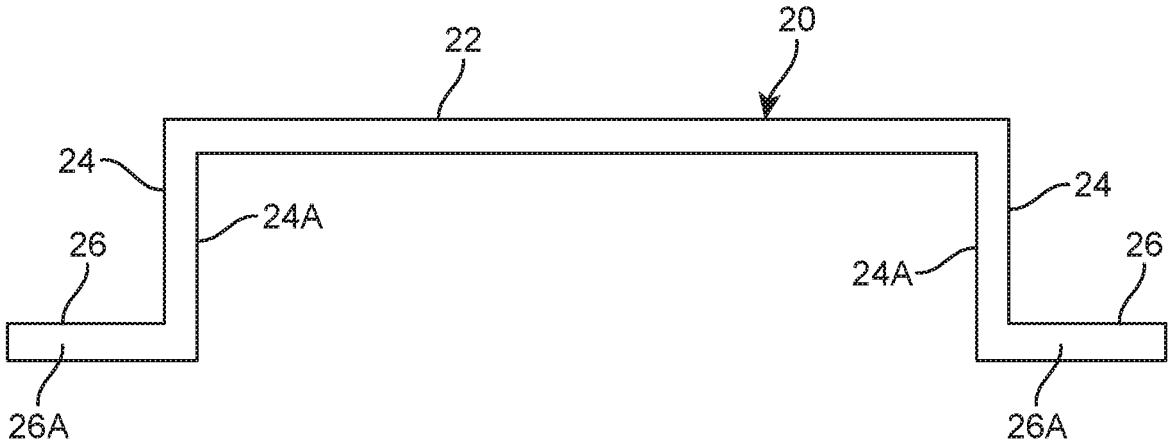
FIG. 5 shows a front view of lift attachment 10 in accordance to an embodiment of the present invention.
Figure 6:
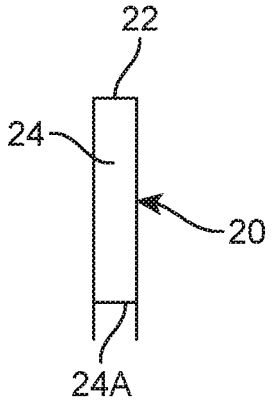
FIG. 6 illustrates a side view of lift attachment 10 in accordance to an embodiment of the present invention.

Referring now to the drawings, where the present invention is generally referred to with numeral 10, it can be observed a lift attachment 10 which includes a lift assembly 20, a jack assembly 40, and a motorcycle 52.

Lift assembly 20 includes a horizontal support section 22. In one embodiment, horizontal support section 22 may be cubic rectangular in shape. Furthermore, horizontal support section 22 may also be made of any suitable material. This material may include a metal material or any other material that is suitable to support motorcycle 52. Additionally, horizontal support section 22 may be provided in a solid configuration or in a hollow configuration. It should be understood that any of these configurations may be used for horizontal support section 22. Horizontal support section 22 includes a substantially suitable length to fit under motorcycle 52. Other embodiments may also provide horizontal support section 22 of other suitable lengths for additional vehicles. It should be understood that the length of horizontal support section 22 may be changed to fit any two to four-wheel vehicle that is available to a user. Lift assembly 20 further includes vertical members 24. In one embodiment, vertical members 24 are each a rectangular plate having vertical member sidewalls 24A. Additionally, vertical members 24 are located on each end of horizontal support section 22. Vertical members 24 may entirely cover each end of horizontal support section 22. Furthermore, vertical members 24 may be removable mounted to horizontal support section 22. In another embodiment, vertical member 24 may be welded integrally to horizontal support section 22. Vertical member sidewalls 24A extend inwardly toward horizontal support section 22. Such a configuration of vertical member sidewalls 24A allows a user to stack lift attachment 10 on top of one another. In one embodiment, vertical members 24 include horizontal jack attachment members 26 mounted to each end of said vertical members 24. Additionally, horizontal jack attachment members 26 may be a rectangular metal plate horizontally mounted to each end of vertical members 24. Horizontal jack attachment members 26 may further include attachment member sidewalls 26A extending downwardly to a ground surface. In one embodiment, attachment member sidewalls 26A are integrally connected to vertical member sidewalls 24A. Additionally, the sidewalls are connected in such a way that an inner channel is formed therein vertical members 24 and horizontal jack attachment members 26. In one embodiment, vertical members 24 are each of the same height. However, other embodiments may include vertical members 24 of varying heights. In another embodiment, vertical members 24 have a height significantly less than a length of horizontal support section 22. Furthermore, horizontal jack attachment members 26 may have a length that is less than a height of vertical members 24. Lift assembly 20 provides the necessary configuration that is optimized to be used with jack assembly 40.

Jack assembly 40 includes jacks 42. It should be understood that jacks 42 may be any suitable jacks available in the market for a user. This may include a manual jack or a hydraulic bottle jack. In one embodiment, an automatic electric jack may be used for jacks 42. It should be understood that any variation of jacks may be used for jacks 42. In one embodiment, lift attachment 10 is placed underneath a motorcycle 52 in need of repair and is used with at least two of jacks 42. Each of jacks 42 is then placed underneath horizontal jack attachment members 26. In one embodiment, a hydraulic bottle jack is placed underneath horizontal jack attachment 42. Attachment member sidewalls 26A may extend downwardly and cover a predetermined amount of the hydraulic bottle jack. A user may then actuate jacks 42 placed underneath horizontal jack attachment members 26. Jacks 42 then apply an upward force to horizontal jack attachment members 26. As a result, lift assembly 20 having motorcycle 52 mounted thereon is also lifted a predetermined height. A user is then freely able to perform the necessary repairs needed on motorcycle 10. Lift attachment 10 provides a user the most optimal method of lifting a motorcycle for performing maintenance. It should be understood, that other four-wheel vehicles may be used with lift attachment 10. Furthermore, lift attachment 10 can also have other uses such as being configured as a platform for convenient storage for a user's materials.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a lift attachment, comprising:

a. a lift assembly, including a horizontal support section and vertical members, said horizontal support section having a cubic rectangular shape and extending a predetermined length, wherein said vertical members are located on each end of said horizontal support section, said vertical members are removably mounted to said horizontal support section, said vertical members each being a rectangular plate having vertical member sidewalls, wherein said vertical member sidewalls extend inwardly toward said horizontal support section, wherein each of said vertical members terminate in horizontal jack attachment members, wherein said horizontal jack attachment members are each a rectangular plate having attachment member sidewalls extending downwardly to a ground surface, said attachment member sidewalls form an inner channel therebetween, wherein said attachment member sidewalls of said horizontal jack attachment members are removably connected to said vertical member sidewalls of said vertical members; and b. a jack assembly, including at least two jacks being hydraulic bottle jacks, each having a cylindrical top end, said lift assembly is configured to be mounted underneath a bottom of a motorcycle, wherein said cylindrical top end is mounted on the channel formed underneath said horizontal jack attachment members, wherein said attachment member sidewalls of said horizontal jack members extend downwardly to cover a portion of said cylindrical top end of said hydraulic bottle jacks, wherein a user actuates said hydraulic bottle jacks to lift said lift assembly and the motorcycle.

2. The system for a lift attachment of claim 1 wherein said horizontal support section, said vertical members, and said horizontal jack attachment members are all welded together.

3. The system for a lift attachment of claim 1 wherein said vertical members are an identical height.

4. The system for a lift attachment of claim 1 wherein said horizontal support section, said vertical members, and said horizontal jack attachment members are made of a metal material.

5. The system for a lift attachment of claim 1 wherein said vertical members each have a height significantly less than a length said horizontal support section.

6. The system for a lift attachment of claim 1 wherein said horizontal jack attachment members have a length that is less than a height of said vertical members.

7. The system for a lift attachment of claim 1 wherein said at least two jacks are a manual car jack.

8. A system for a lift attachment, consisting of:

a. a lift assembly, including a horizontal support section and vertical members, said horizontal support section having a cubic rectangular shape and extending a predetermined length, each of said vertical members has an identical height, each of said vertical members has a height significantly less than a length said horizontal support section, wherein said vertical members are located on each end of said horizontal support section, said vertical members are removably mounted to said horizontal support section, said vertical members each being a rectangular plate having vertical member sidewalls, wherein said vertical member sidewalls extend inwardly toward said horizontal support section, wherein each of said vertical members terminate in horizontal jack attachment members, wherein said horizontal jack attachment members are each a rectangular plate having attachment member sidewalls extending downwardly to a ground surface, said horizontal jack attachment members have a length that is less than a height of said vertical members, said attachment member sidewalls form an inner channel therebetween, wherein said attachment member sidewalls of said horizontal jack attachment members are integrally connected to said vertical member sidewalls of said vertical members, wherein said horizontal support section, said vertical members, and said horizontal jack attachment members are made of a metal material; and b. a jack assembly, including at least two jacks being hydraulic bottle jacks, each having a cylindrical top end, said lift assembly is configured to be mounted underneath a bottom of a motorcycle, wherein said cylindrical top end is mounted on the channel formed underneath said horizontal jack attachment members, wherein said attachment member sidewalls of said horizontal jack members extend downwardly to cover a portion of said cylindrical top end of said hydraulic bottle jacks, wherein a user actuates said hydraulic bottle jacks to lift said lift assembly and the motorcycle.

* * * * *